United States Patent [19]

Rossoshinsky et al.

[11] 4,424,106

[45] Jan. 3, 1984

[54] ELECTROLYTIC FILTER PRESS CELL FOR PRODUCING A MIXTURE OF HYDROGEN AND OXYGEN

[75] Inventors: Alexei A. Rossoshinsky; Valentin I. Balakin; Alexandr K. Babak; Vladimir K. Lebedev, all of Kiev; Lev G. Mironov, Moscow; Gennady I. Chelnokov, Moskovskaya oblast, Mytischi; Gennady V. Vinogradov, Moscow, all of U.S.S.R.

[73] Assignee: Institut Elektrosvarki Imeni E.O. Patona, U.S.S.R.

[21] Appl. No.: 325,482

[22] Filed: Nov. 27, 1981

[51] Int. Cl.[3] ..... C25B 1/08; C25B 1/10; C25B 11/02

[52] U.S. Cl. ..... 204/256; 204/268; 204/270; 204/129

[58] Field of Search ..... 204/129, 268–270, 204/254–256

[56] References Cited

U.S. PATENT DOCUMENTS

| | | | |
|---|---|---|---|
| 3,310,483 | 3/1967 | Rhodes | 204/268 |
| 3,948,750 | 4/1976 | Figueras et al. | 204/268 X |
| 4,206,029 | 6/1980 | Spirig | 204/270 X |
| 4,336,122 | 6/1982 | Spirig | 204/269 X |

FOREIGN PATENT DOCUMENTS

| | | | |
|---|---|---|---|
| 2410059 | 7/1979 | France | 204/257 |

*Primary Examiner*—Donald R. Valentine
*Attorney, Agent, or Firm*—Steinberg & Raskin

[57] ABSTRACT

In an electrolytic cell for producing a mixture of hydrogen and oxygen bipolar electrodes adapted for operating electrically in series have a through shaped configuration and are arranged so that their depressions are on one and like side. Interposed between the electrodes are gaskets of electrical insulating material forming the cell tank. Each gasket is placed around the edges of the electrode depression so that a portion thereof axially of the electrolytic cell is in touch with the adjacent electrode. The electrolytic cell is held as a unit with studs extending through openings in peripheral portions of the electrodes that project laterally of the electrolytic cell.

9 Claims, 4 Drawing Figures

ELECTROLYTIC FILTER PRESS CELL FOR PRODUCING A MIXTURE OF HYDROGEN AND OXYGEN

BACKGROUND OF THE INVENTION

1. Field of the Invention

The invention relates to improvements in electrolytic filter press cells for producing a mixture of hydrogen and oxygen for direct utilization in torches during flame cutting, brazing and welding.

2. Description of the Prior Art

In U.S. Pat. No. 3,310,483 disclosed is an electrolytic cell comprising a tank of electrical insulating material and adapted to contain electrolyte as well as to hold a plurality of electrolizing plates, which are contained in grooves of a sufficient depth in the side walls and the bottom of the tank and are held in position by fastener means such as bolts. The electrolizing plates are spaced from each other in parallel series along the tank length and form compartments therebetween. Electric current is fed to pass in series from the first electrode to the last one. The electrolyte volume in all the compartments may be equalized, when adding makeup water, by tilting the cell until the electrolyte overruns the upper edges of the plates.

Tests have shown that the prior art electrolytic cell has some problematic characteristics, namely inadequate removal of heat from the electrolizing compartments since the tank is of the material that is not heat conductive, which results in overheating the electrolyte and leads to disturbances in the cell operation; the electrodes contained in grooves in the tank of electrical insulating material do not ensure complete prevention of short circuiting of electrical current around the edges of the plates; slots between the plate edges and the tank material are inavoidable; the electrolizing plates are insufficiently secured in the tank since not all the edges are contained in grooves; difficulty in solving the sealing problem consisting in that the top of the tank is to be connected to the side wall upper edges of a considerable length.

A solution to the problem involved would provide a more reliable electrolytic cell of the kind described.

SUMMARY OF THE INVENTION

An object of the invention is to provide an improved electrolytic filter press cell for producing a mixture of hydrogen and oxygen, characterized by an increased reliability.

Another object of the invention is to provide an improved electrolytic filter press cell for producing a mixture of hydrogen and oxygen, wherein removal of heat from the cell compartments is intensified though the tank is made of electrical insulating material.

A further object of the invention is to provide an improved electrolytic filter press cell for producing a mixture of hydrogen and oxygen, wherein there is a tighter seal between the electrode and the tank.

Still further object of the invention is to provide an improved electrolytic filter press cell for producing a mixture of hydrogen and oxygen, wherein the electrodes are held in the tank along the continuous line of contact, which enhances reliability of holding the electrodes.

Also an object of the invention is to provide an improved electrolytic filter press cell for producing a mixture of hydrogen and oxygen, capable of operation at higher internal pressures, which makes it possible to exercise a full control of flame size when the cell is utilized as a source of gas supply for a torch.

These and other objects are attained by the provision of an electrolytic filter press cell for producing a mixture of hydrogen and oxygen comprising a tank adapted to contain electrolyte, made of electrical insulating material and divided into compartments by spaced bipolar electrodes held in position by fastener means, wherein, according to the invention, the bipolar electrodes are trough-shaped with depressions provided on one and like side of each of the electrodes, and side walls of the tank are formed as a frame, each of which is placed around the edges of the depression in each of the bipolar electrodes.

Such a series of frames made from electrical insulating material and the trough-shaped electrodes can be readily assembled to form a unit, since frame locations are invariably predetermined, and connecting them with the fastener means is effected smoothly.

The number of unified structural members adapted to form compartments arranged in series and containing electrolyte can be decided upon according to a required supply voltage, specifically a supply-line voltage, thereby obviating the necessity of utilizing a step-down transformer and the related difficulties.

Gases are produced on the equal-area electrodes, since all the electrodes are preferably made alike. This provides for the highest possible effectiveness in using the electrode surface immersed in the electrolyte, thereby ensuring a uniform load on the electrodes and, consequently, a uniform heat release through the volume of electrolyte. An intensive heat transfer from the electrolyte contained in the tank of electrical insulating material to the environmental atmosphere is due to a high heat conductivity of the metallic electrodes projecting outside the tank. Since the frames are arranged in the depressions and along the edges thereof, then a portion of the electrode will anyway project outside the compartment containing electrolyte. Inasmuch as heat is released practically from the whole volume of electrolyte, additional cooling means are unnecessary.

According to one aspect of the invention each frame can comprise a diaphragm having vents extending therethrough so that their center lines make an angle with the plane of the diaphragm, ranging from 30° to 60°, and a port provided in the lower portion of the diaphragm and measuring upwardly $\frac{1}{3}$ of the diaphragm vertical extent.

In the electrolytic cells of the kind contemplated by the present invention, a divider diaphragm is not usually required because it is undesirable to produce gases separately. But with the end of increasing yield, however, use is made of the electrodes having porous coverings at both anode and cathode sides, in which case macroporous diaphragms are indispensable. This requirement stems from the fact that if the porous covering is inadequately secured to the electrode surface, it may peel off in the course of the cell operation. Such a peeling off may result in the formation of ohmic bridges between the electrodes to cause heating of the portion. If such a portion (ohmic bridge) is formed in electrolyte, it will cause heating in general. But if it is formed in the atmosphere consisting of a mixture of hydrogen and oxygen gases, an explosion in the electrolytic cell is the result. The latter phenomenon can make the electrolytic cell inoperative, or expressing it in another way, such an electrolytic cell is unreliable.

The vents in the diaphragm extending so that their center lines make an angle with the plane of the diaphragm, ranging from 30° to 60°, prevent the formation of the ohmic bridges when the peeling off occurs, but in no case increase resistance to passage of an electric current and escaping gases. The vertical extent of the port, which is $\frac{1}{3}$ of that of the diaphragm is preferable since it is the minimum level of the electrolyte when the electrolytic cell retains its efficiency. Moreover, the diaphragm provided in the frame makes it possible, in case of an explosion and breakdown of the cell, to rapidly restore such a cell with unified parts.

According to an alternative aspect of the invention the depressions of the electrodes have grooves of a vertically increasing cross-section, the cathode side of the electrode being the side of the depression. Such arrangement provides for an improved circulation of electrolyte due to directional motion of bubbles of hydrogen gas in the cell. Grooves having a 10° to 15° slope from the vertical provide for about 10% increase in the current density.

BRIEF DESCRIPTION OF THE DRAWINGS

The invention will now be described more fully, by way of example with reference to several embodiments thereof, which are illustrated in the accompanying drawings, in which.

DESCRIPTION OF THE PREFERRED EMBODIMENTS

Figure 1:
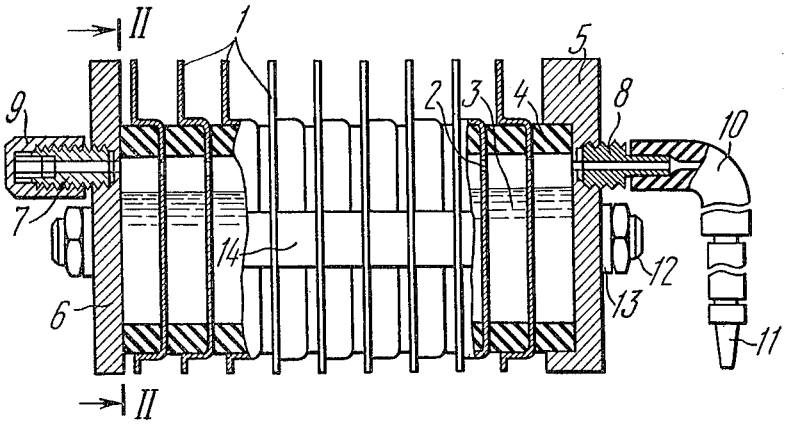
FIG. 1 is a view in longitudinal section of an electrolytic cell of the invention.
Figure 2:
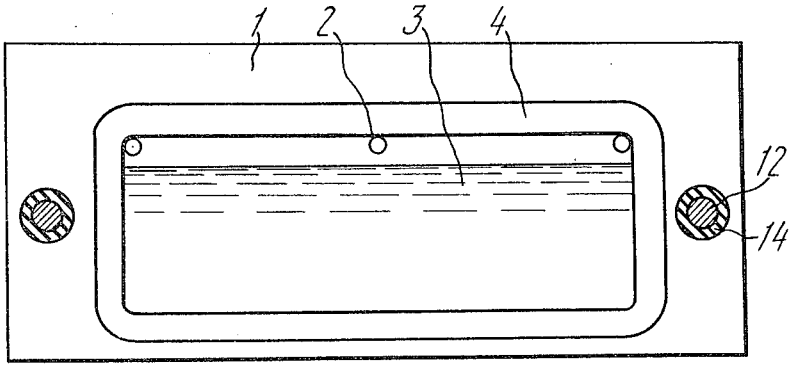
FIG. 2 is a view taken on the line 2—2 of FIG. 1.

Referring now to FIGS. 1 and 2 of the drawings, the electrolytic filter cell for producing a mixture of hydrogen and oxygen includes through shaped electrodes 1 having depressions on one and like side and openings 2 disposed above the level of electrolyte 3 and within the area limited by frames of electrical insulating material or gaskets 4 forming side walls of the tank of the cell and made from, for example, rubber. As can be seen in the drawings, particularly in FIG. 1, the gaskets 4 are placed in the depressions of the electrodes 1 such that the portion thereof is on the edges of the depressions and the other portion is projecting out of the depression and abuts the adjacent electrodes.

At the end portions of the electrolytic cell the tank thereof is defined by plates 5 and 6 made of metal. The metal plate 5 has a depression corresponding to the depressions in the through shaped electrodes 1, whereas the plate 6 is flat. The plates 5 and 6 comprise outlet pipes 7 and 8, of which one designated 7 is provided with a sealing cap 9 and the other pipe 8 communicates via a pipe line 10 with a torch 11. The tank of the cell is held as a unit by studs 12, which connect gaskets 4 between the plates 5 and 6 and at the same time act as guides during assembly. As is shown in FIG. 1, the electrode structure makes it possible to project the periphery thereof as is desired outside the tank.

Instead of studs 12 there may be used bolts, screws or other fasteners suitable for the present case. The studs 12 extending through coaxial openings in the metal plates 5 and 6 and the electrodes 1 are insulated therefrom by insulating washers 13 and insulating covering 14.

An equal level of the electrolyte 3 is achieved either by tilting the tank when the cell is primed or through openings provided in the lower portion of each electrode, that is the portion submerged in the electrolyte.

The direct current may be supplied to the electrodes in any known way in accordance with desired characteristics of the cell. It is preferred to supply current to the metal plates 5 and 6 (the possible charge to one of them and the negative one to the other), thereby the electrolytic cells or compartments operate in series and the number of them may be decided upon so that the electrolytic cell may operate from the current source available thus obviating a step-down transformer. In this case the rectifier may be adapted to handle lower currents.

In operation, passing of a direct current through an alkaline electrolyte 3 causes water dissociation and produces hydrogen and oxygen gases from the electrodes 1 and the plates 5 and 6 (which operate as electrodes), which gases intermix in the space above the electrolyte level, in other words within the tank of electrical insulating material a detonating or oxyhydrogen gas is produced. The gas flows through the openings 2 and the outlet pipe 8, reaches the torch 11 to be burnt at its outlet nozzle thereby producing a high-temperature flame for use in the gas-flame engineering.

Inasmuch as the electrodes are shaped so as to insure a highgrade assembly, the electrolytic cell affords higher operational pressures without a risk of failure. This makes it possible to exercise a more effective flame and to expand the scope of working of the torch supplied from such an electrolytic cell, and at the same time to afford safety of operation.

The time of assemblying the electrolytic cell with the trough-shaped electrodes is $\frac{1}{4}$ of that of assembling the electrolytic cell with flat electrodes of an equally comparable size, the quality being the same.

Other advantages of the cell of the invention are as follows: a more effective heat release from the whole volume of the electrolyte due to the fact that the peripheral portion of the electrodes is outside the tank; possibility of using unified members which allow the cell of required characteristics to be assembled; simplicity of manufacturing, assembly, disassembly and operation.

Figure 3:
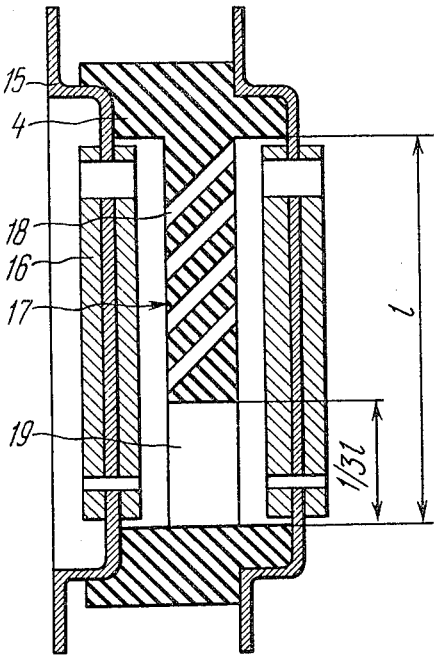
FIG. 3 is an alternative embodiment of the invention illustrating one compartment of the electrolytic cell.

According to an alternative embodiment, the electrolytic cell (FIG. 3) comprises electrodes 15 having porous covering 16, diaphragms 17, which are also acting as dielectric separators and have vents 18 and a port 19. The vents 18 are extending in the diaphragm so that their center lines make an angle with the vertical or the plane of the diaphragm, ranging from 30° to 60°, and the port 19, as shown in FIG. 3, is measuring upwardly $\frac{1}{3}$ of the diaphragm vertical extent (h).

In operation hydrogen and oxygen gases are produced from the electrodes 15, which gases rise and intermix when they pass through the openings 18 to produce oxyhydrogen gas. That center lines of the vents make with the plane of the diaphragm 17 an angle ranging from 30° to 60°, provide a secure overlap to prevent the formation of the ohmic bridges when the porous covering peels off the electrode surface. In this case current passes through the maximum area whereas resistance in the electrolyte is minimal. The port 19 provided in the diaphragm insures electrolysis to act normally at the minimum resistance to passage of electric current.

To test the inventive concept, electrolytic cells of 40 liters per hour, 80 liters per hour, and 120 liters per hour were assembled with the electrodes having porous coverings and the diaphragm as hereinbefore described and then the porous coverings were peeled off. The diaphragm was made of rubber and 0.8 to 1.0 mm thick, the vents were 0.3 to 0.5 mm in diameter, from 0.8 to 1.0 mm spaced and each vent was sloped from 30° to 60°. The tests have shown a reliable prevention of the formation of the ohmic bridges, which previously caused explosions in the cell. With the diaphragm the resistance to passage of electric current was slightly increased as compared to the cell without the diaphragm.

According to a further embodiment of the invention the electrolytic cell (FIG. 4) is composed of electrolyzing compartments comprising electrodes 20 having grooves 21 in other depressions and of a vertically increasing cross-section or depth (the grooves may equally increase in width since this is evident in the light of the former feature and not shown in the drawings specifically). The side of the electrode forming the bottom of the groove 21 is a cathode side and correspondingly the reverse sidé or projection is anode. The mixture of gases escapes through an opening (not shown) in the dielectric gasket 22 disposed between the electrodes 20.

Figure 4:
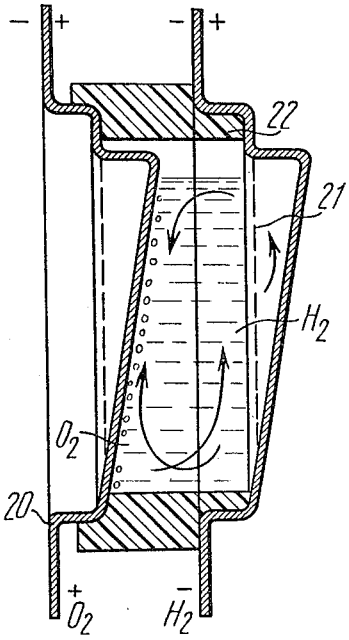
FIG. 4 is a further embodiment of the invention.

In operation, d.c. current is passed through the electrodes 20 and with the electrodes in circuit as shown in FIG. 4 oxygen gas will be produced from the anode (+) and hydrogen gas from the cathode (−). Since the volume of hydrogen produced is twice as large as that of oxygen, with the grooves sloped the bubbles of hydrogen easily leave the surface of the cathode and ascend with a greater speed than do the bubbles of oxygen. Thus a directional motion of the electrolyte in the compartment is established and the gas in content in the electrolyte is reduced.

An electrolytic cell according to the present embodiment was tested in the developmental facilities of the applicant. The electrolytic cell was designed for a 80 liters per hour yield. The electrodes had sloped grooves in the depressions thereof and were made of nickel, the thickness of the thickness of the electrode being 0.6 mm with a groove 3 mm deep and 5 mm wide. Each electrode had five grooves 115 mm long or high. The tests have shown an adequate circulation of the electrolyte and a reduced content of gas in the electrolyte. Current densities on the electrodes were 70 $mA/cm^2$ instead of 50 $mA/cm^2$ as in the prior art cells. Thus, with the electrolytic cell having identical structural features there is a further possibility to enhance its efficiency in proportion to an increase in the current density on the electrodes.

What is claimed is:

1. In an electrolytic filter press cell for producing a mixture of hydrogen and oxygen having a tank adapted to contain electrolyte, made of electrical insulating material and including end walls and side walls, a plurality of spaced individual bipolar electrodes forming compartments therebetween and between the walls of said tank, and fastener means for holding said individual electrodes in position, the improvement which comprises the provision of a depression on the same side of each of said individual bipolar electrodes, with each electrode having a trough-shaped configuration substantially identical to an adjacent electrode, and in which said side walls of said cell are formed as a plurality of frames, with a frame situated around an inner edge of the depression in each individual bipolar electrode.

2. In the electrolytic filter press cell of claim 1, the improvement in which each of said frames separates a bipolar electrode from an adjacent bipolar electrode or from the end wall of said cell, with said frame separating an electrode from an adjacent bipolar electrode or from one of said two end walls of said cell, being situated around an inner edge of the depression in the individual bipolar electrode being separated.

3. In the electrolyte filter press cell of claim 1, the improvement in which each electrode is formed as a solid, integral unit.

4. In the electrode filter press cell of claim 3, the improvement in which a portion of each electrode projects outside the respective compartment containing electrolyte.

5. In the electrode filter press cell of claim 4, the improvement in which each individual bipolar electrode comprises an opening for conveying said hydrogen and oxygen gas mixture, said opening situated in the depression in the individual bipolar electrode above the level of electrolyte.

6. In an electrolytic filter press cell for producing a mixture of hydrogen and oxygen having a tank adapted to contain electrolyte, made of electrical insulating material and including end walls and side walls, a plurality of spaced bipolar electrodes forming compartments therebetween and between the walls of said tank, and fastener means for holding said electrodes in position, the improvement which comprises the provision of a depression on the same side of each of said electrodes, with each electrode having a trough-shaped configuration, in which said side walls are formed as a plurality of frames with a frame situated around the edges of the depression in each of said bipolar electrodes, and in which each frame comprises a diaphragm having at least one vent extending therethrough with a center line of said at least one vent forming an angle of 30° to 60° with the plane of the diaphragm.

7. In an electrolytic filter press cell of claim 6, the improvement in which said diaphragm extends from the top of a respective compartment, about two thirds the distance between respective sidewalls of said respective compartment.

8. In an electrolytic filter press cell for producing a mixture of hydrogen and oxygen having a tank adapted to contain electrolyte, made of electrical insulating material and including end walls and side walls, a plurality of spaced bipolar electrodes forming compartments therebetween and between walls of said tank, and fastener means for holding said electrodes in position, the improvement which comprises the provision of a depression in the same side of each of said electrodes, with each electrode having a trough-shaped configuration, in which said side walls are formed as a plurality of frames with a frame situated around the edges of the depression in each of said bipolar electrodes, and in which the depressions of the respective electrodes have grooves of vertically increasing cross-section, the cathode side of each electrode being the side of the depression.

9. In the electrode filter press cell of claim 8, the improvement in which said grooves have a 10° to 15° slope from the vertical.

* * * * *